US007428865B1

(12) United States Patent
Kasel et al.

(10) Patent No.: US 7,428,865 B1
(45) Date of Patent: Sep. 30, 2008

(54) PRESS-TYPE STRAPPING MACHINE

(75) Inventors: Calvin E. Kasel, Wauconda, IL (US); Arland L. Morrison, Port Barrington, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/860,200

(22) Filed: Sep. 24, 2007

(51) Int. Cl.
*B65B 13/04* (2006.01)
*B65B 61/00* (2006.01)

(52) U.S. Cl. ..... 100/3; 100/4; 100/7; 100/26; 100/29; 53/139.7; 53/529; 53/589

(58) Field of Classification Search ..... 100/3, 100/4, 7, 8, 26, 29, 32; 53/139.6, 139.7, 53/529, 582, 589
See application file for complete search history.

(56) References Cited

U.S. PATENT DOCUMENTS 3,735,555 A * 5/1973 Pasic ..... 53/529
4,587,791 A * 5/1986 Brouse et al. ..... 53/139.6
5,289,668 A * 3/1994 Meyer ..... 53/410
5,619,838 A * 4/1997 Kasel ..... 53/139.7

* cited by examiner

*Primary Examiner*—Jimmy T Nguyen
(74) *Attorney, Agent, or Firm*—Mark W. Croll; Donald J. Breh; Levenfield Pearlstein, LLC

(57) ABSTRACT

A strapping machine includes a frame, a vertically movable upper carriage, a strap chute including an upper leg mounted to the movable upper carriage, a pair of spaced apart compression plates mounted to the movable upper carriage for vertically compressing the load and a pair of side squaring elements movable toward and away from one another configured figured for horizontal movement to contact the sides of the load. The side squaring elements are disposed between the compression plates. The machine is controlled by a control system such that following a first strapping cycle and prior to a second strapping cycle the control system generates a signal to raise the compression plates from the load about 3 inches and a to move the side squaring elements away from the load about 3 inches. The machine includes a corner pad applicator assemblies for applying a corner pad at each of the upper corners of the load prior to positioning, tensioning and sealing the strapping material to itself about the load.

23 Claims, 12 Drawing Sheets

PRESS-TYPE STRAPPING MACHINE

BACKGROUND OF THE INVENTION

This invention pertains to a strapping machine. More particularly, this invention pertains to a press-type strapping machine for squaring and strapping large material loads such as lumber and the like.

Strapping machines are well-known in the art. There are two principle types of strapping machines, manual and automatic, table-top or free-standing machines. Strapping machines are typically designed for use with either plastic or metal (steel) strapping. These machines position, tension and seal strap around a load to bundle or secure the load.

A typical automatic strapping machine includes a frame-like support for the overall machine, a working area to, for example, support a load, a feed head to feed strap around the load and to retract strap prior to tensioning, a chute through which the strap is fed around the load, a strapping head to secure the strap to itself and one or more dispensers for dispensing the strap material to the strapping head.

Many such strapping machines also provide for squaring and compressing a load during the strapping cycle. That is, an upper compression plate or platen may press downwardly on the load to provide some measure of compression (even of the load is substantially non-compressible). The machine may also include a squaring assembly to align the load vertically to prevent skewing and/or tipping.

In known press-type strapping machines, the strapping head is displaced from the platen and the side squaring are offset from the platen. As such, although compression and squaring occur, they do not occur at the same region of the load (not at the same longitudinal position along the load) nor in a manner such that strapping occurs at the compressed and squared location.

Accordingly, there is a need for a press-type strapping machine that compresses and squares a load at about the same longitudinal position along the load. Desirably, such a machine positions, tensions and seals the strap at about the compressed and squared region. More desirably, such a machine applies protecting elements at the corners of the load to prevent marring or damage of the load by the strapping material.

BRIEF SUMMARY OF THE INVENTION

A strapping machine of the type for positioning, tensioning and sealing a strapping material to itself around a load includes a frame, a vertically movable upper carriage, and a strap chute. The strap chute includes an upper leg mounted to the movable upper carriage and variable height side legs mounted to the frame and a bottom leg.

A pair of compression plates are mounted to the movable upper carriage for vertically compressing the load. The compression plate are spaced from one another. A pair of side squaring elements are movable toward and away from one another. The side squaring elements are configured for horizontal movement to contact the sides of the load. The side squaring elements are disposed between the compression plates.

A first drive vertically moves the compression plates simultaneously and a pair of second drives move the side squaring plates simultaneously and independent of one another toward and away from the load.

A strapping head is operably connected to the movable upper carriage. The strapping head is configured to receive a free end of the strapping material, grip the free end and form a seal of the strapping material onto itself.

Machine control is by a control system. The first drive actuates to move the compression plates into contact with the load to compress the load and the second drives actuate to move the side squaring elements into contact with the load to square sides of the load. The load is compressed on both sides of the squaring elements.

In a present embodiment, the side squaring elements include posts mounted to support members for movement toward and away from the sides of the load. The posts are mounted to the support members at a pivot to vertically align out of alignment sides of the load. Each of the pair of second drives is mounted to a respective support member at a location at a lower elevation than the pivot.

The strapping machine includes a corner pad applicator assembly for applying a corner pad at each upper corner of the load prior to positioning, tensioning and sealing the strapping material to itself about the load. The applicator assembly includes a reciprocating arm having a gripper for gripping the corner pad as it is conveyed to the upper corner of the load and releasing the pad when it is positioned at the upper corner of the load. The assembly is mounted pivotally to the vertically movable upper carriage.

A pad clamp contacts the corner pad and temporarily holds the corner pad to the upper corner of the load prior to and during positioning, tensioning and sealing the strapping material to itself about the load. A prefolding element is operably connected to the pad clamp to fold the corner pad about the upper corner prior to positioning, tensioning and sealing the strapping material to itself about the load.

In one embodiment, the gripper is formed from a pair of articulating jaw elements pivotally mounted to one another and to an actuator. Movement of the actuator toward and away from the jaw elements opens and closes the jaw elements. A magazine stores a plurality of corner pads. The pads are retrieved from the magazine and conveyed to the upper corner of the load by the gripper.

A loading sensor senses the presence or absence of the gripper at the magazine to load a corner pad into the gripper, an ejection sensor senses the presence of a pad ejected from the magazine for retrieval by the gripper and a home sensor senses the presence or absence of the corner pad applicator assembly at a home position.

The control system is configured such that following a first strapping cycle on the load at a first location and prior to a second strapping cycle on the load at a second location, spaced from the first location, the control system generates a signal to raise the compression plates from the load about 3 inches and a signal to move the side squaring elements away from the load about 3 inches to move the load to the second location.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
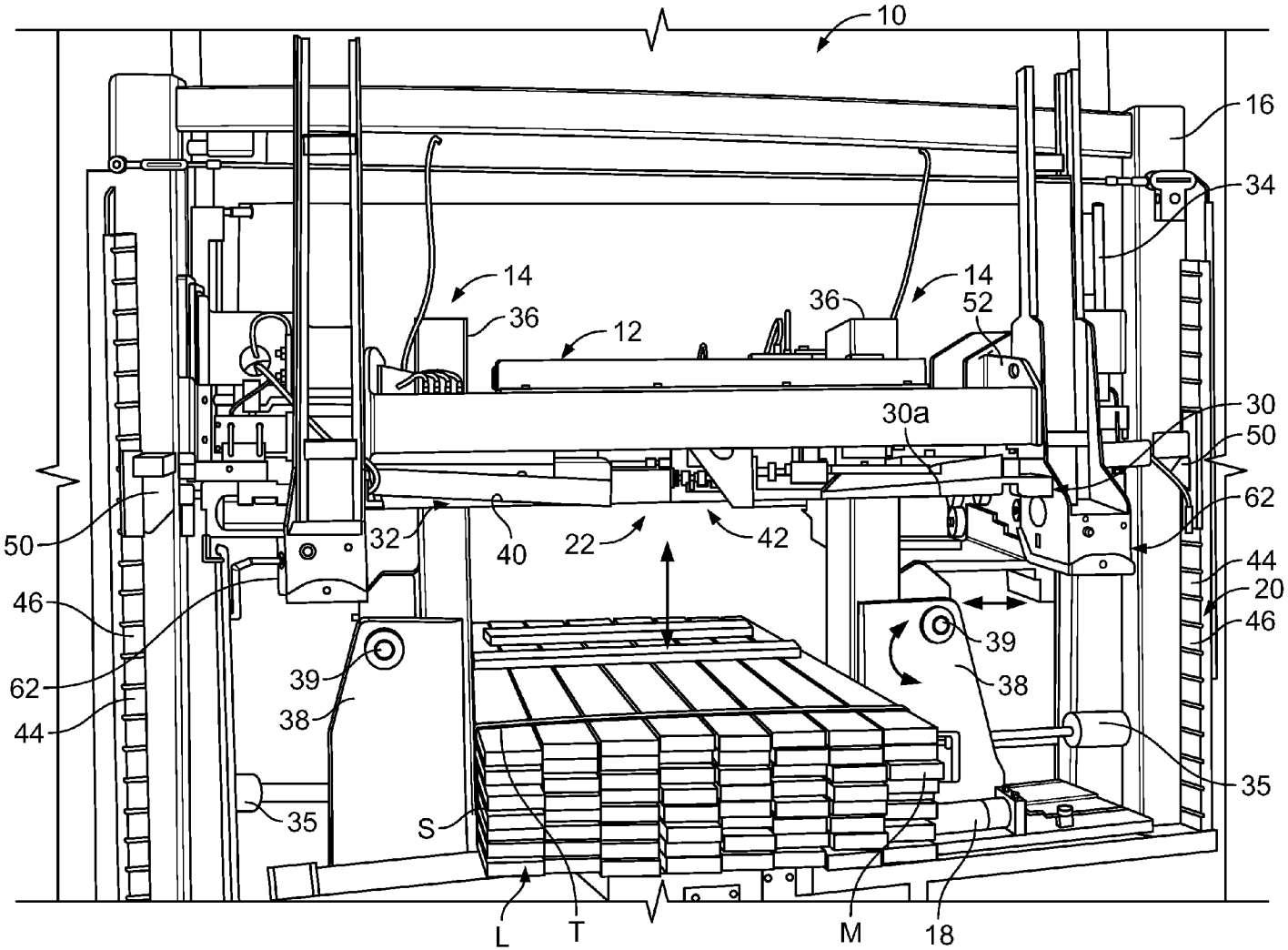
FIG. 1 is a front perspective view of a press-type strapping machine embodying the principles of the present invention, the strapping machine being shown with the side squaring elements in contact with the load and the upper compression plates raised from the load.
Figure 2:
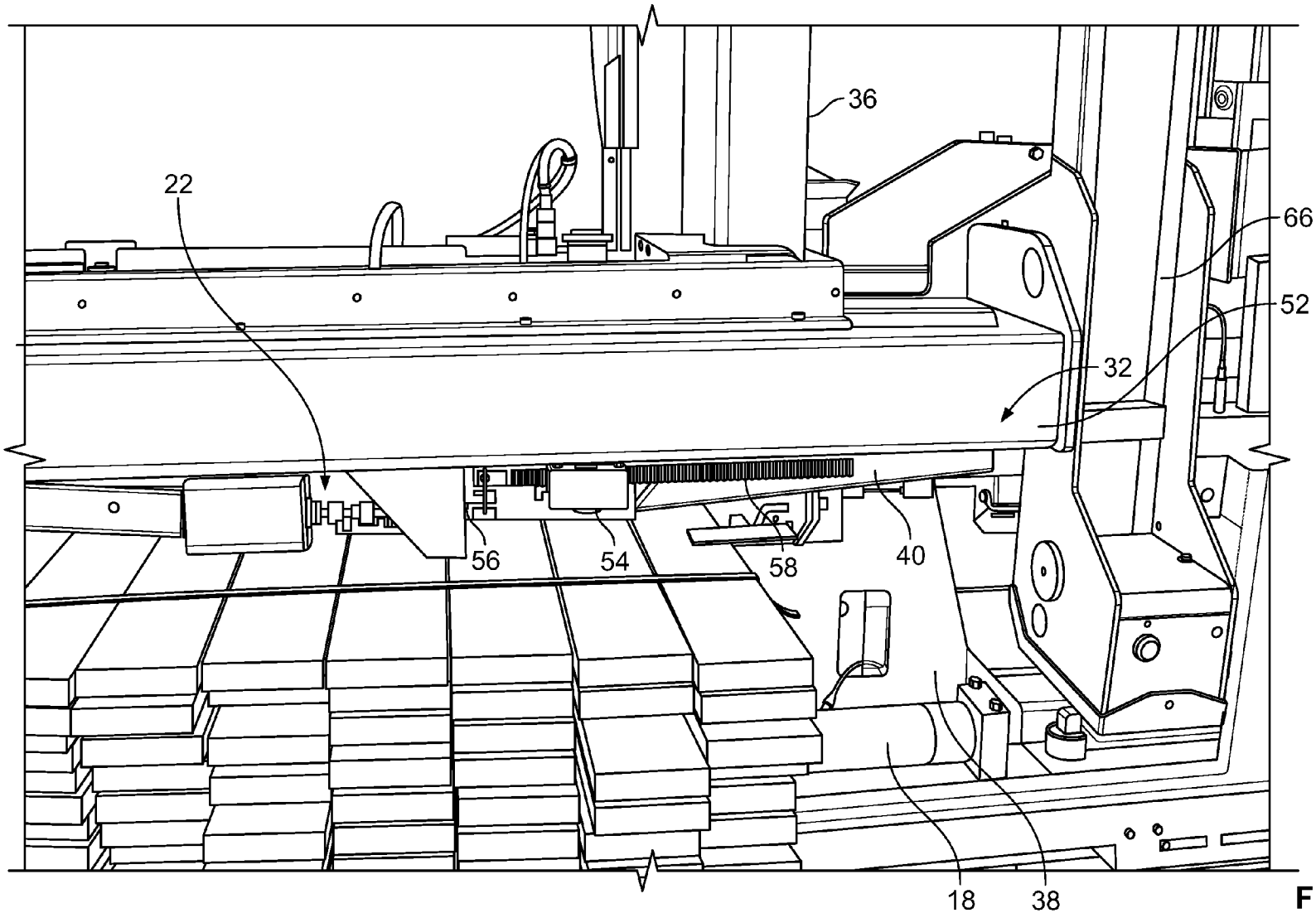
FIG. 2 is a partial front perspective view of the strapping machine showing the upper carriage and the strapping head.
Figure 3:
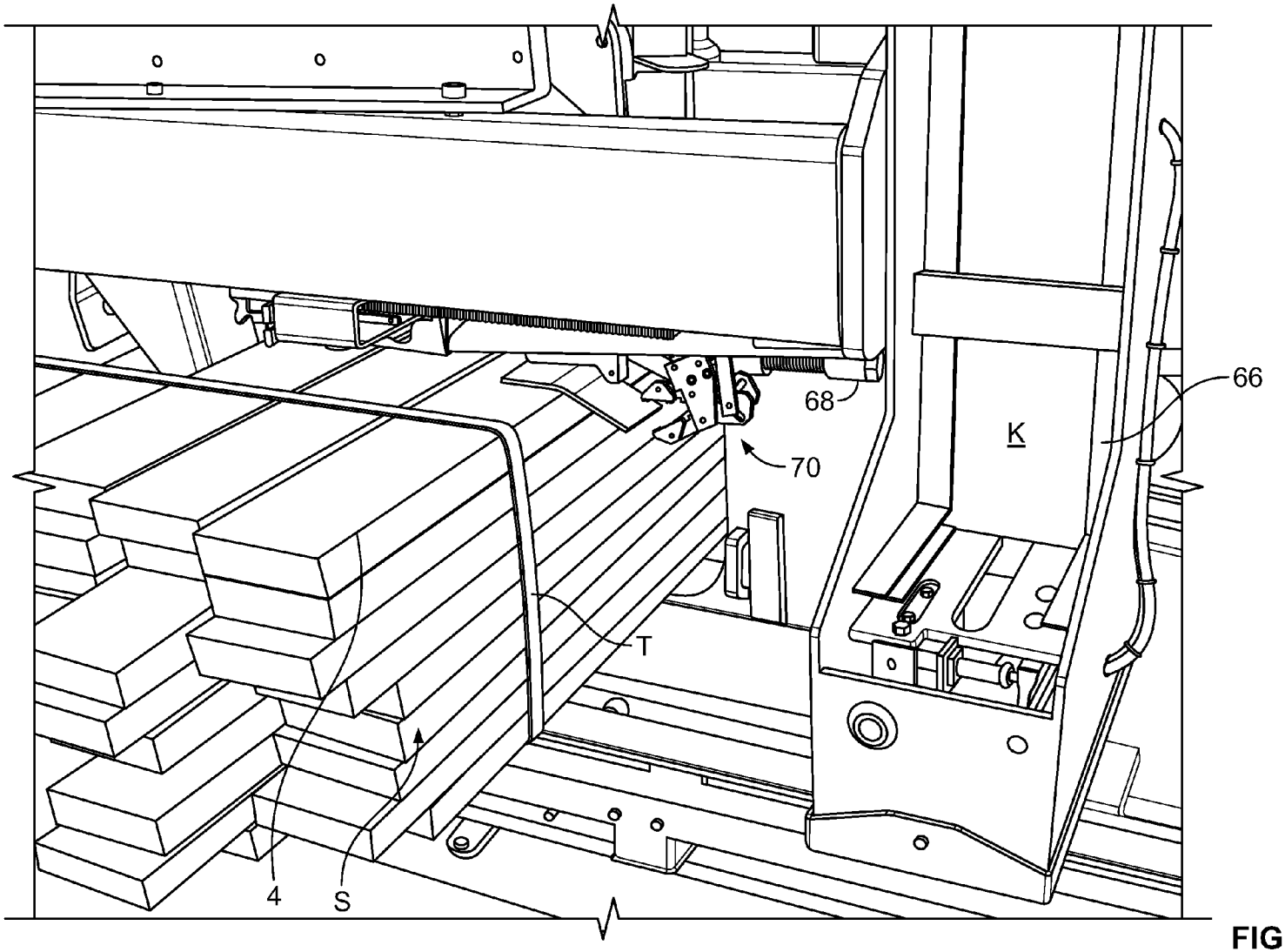
FIG. 3 is a perspective view the strapping machine showing the corner pad applicator and magazine, and a corner pad being held on an upper corner of the load.
Figure 4:
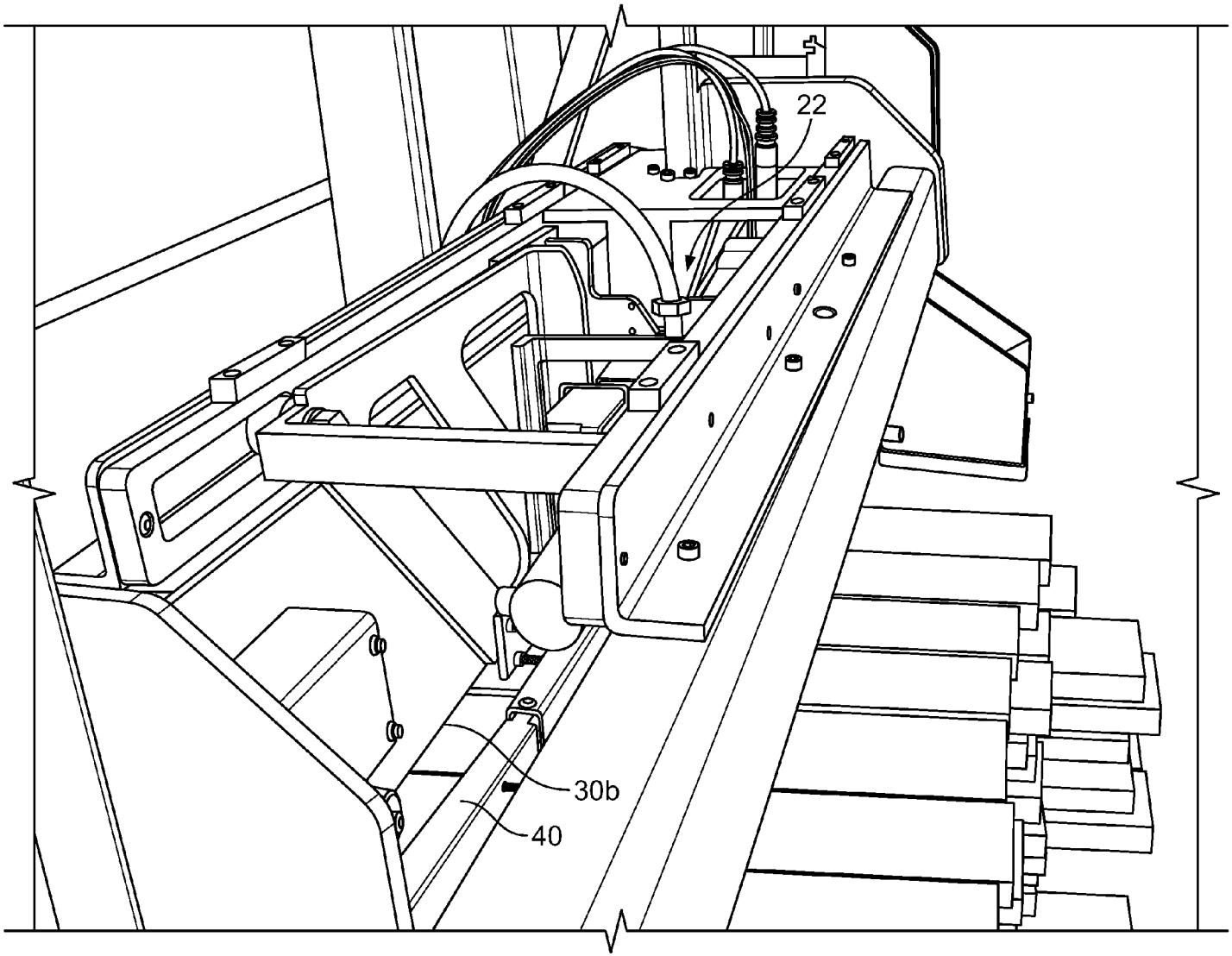
FIG. 4 is a view along the top of the upper carriage.
Figure 5:
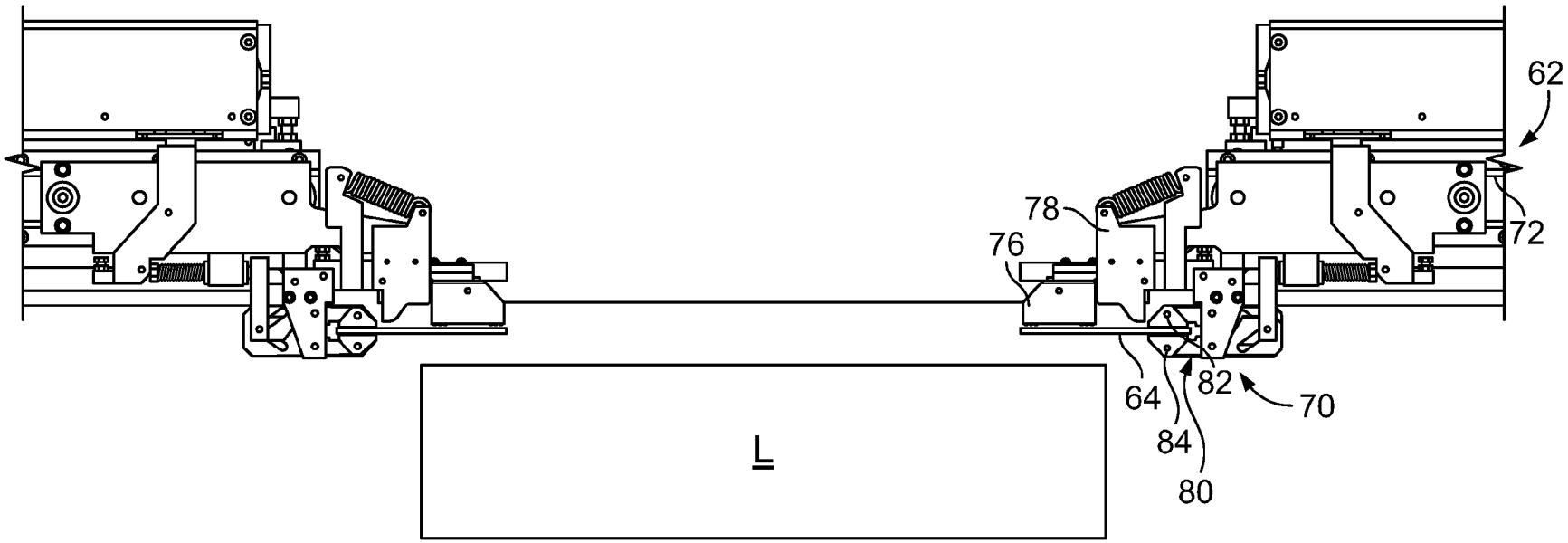
FIG. 5 is a front view illustration of the corner pad applicator showing a pad in each of the applicator grippers and the applicators moving toward the load to apply the pads.
Figure 6:
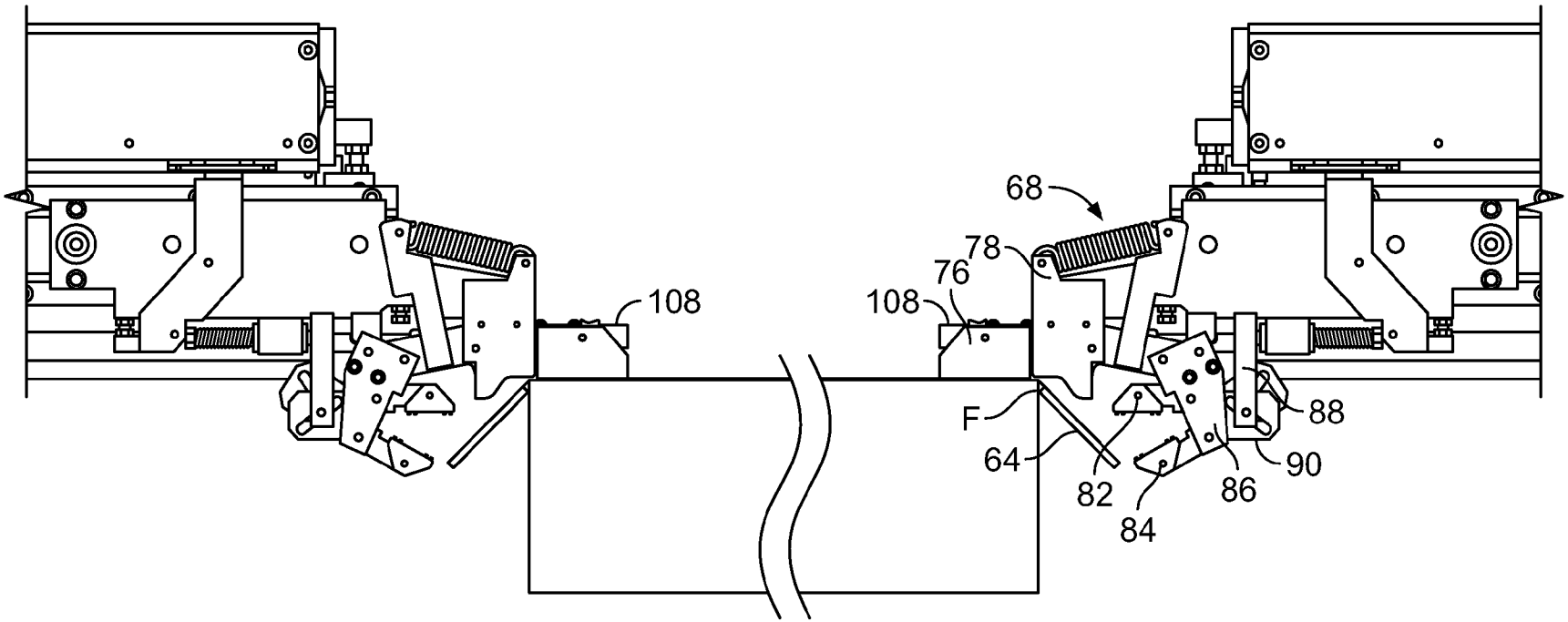
FIG. 6 is an illustration of the applicators as the pads are applied to the load, and showing the prefolder moving downward to contact and fold the pads.
Figure 7:
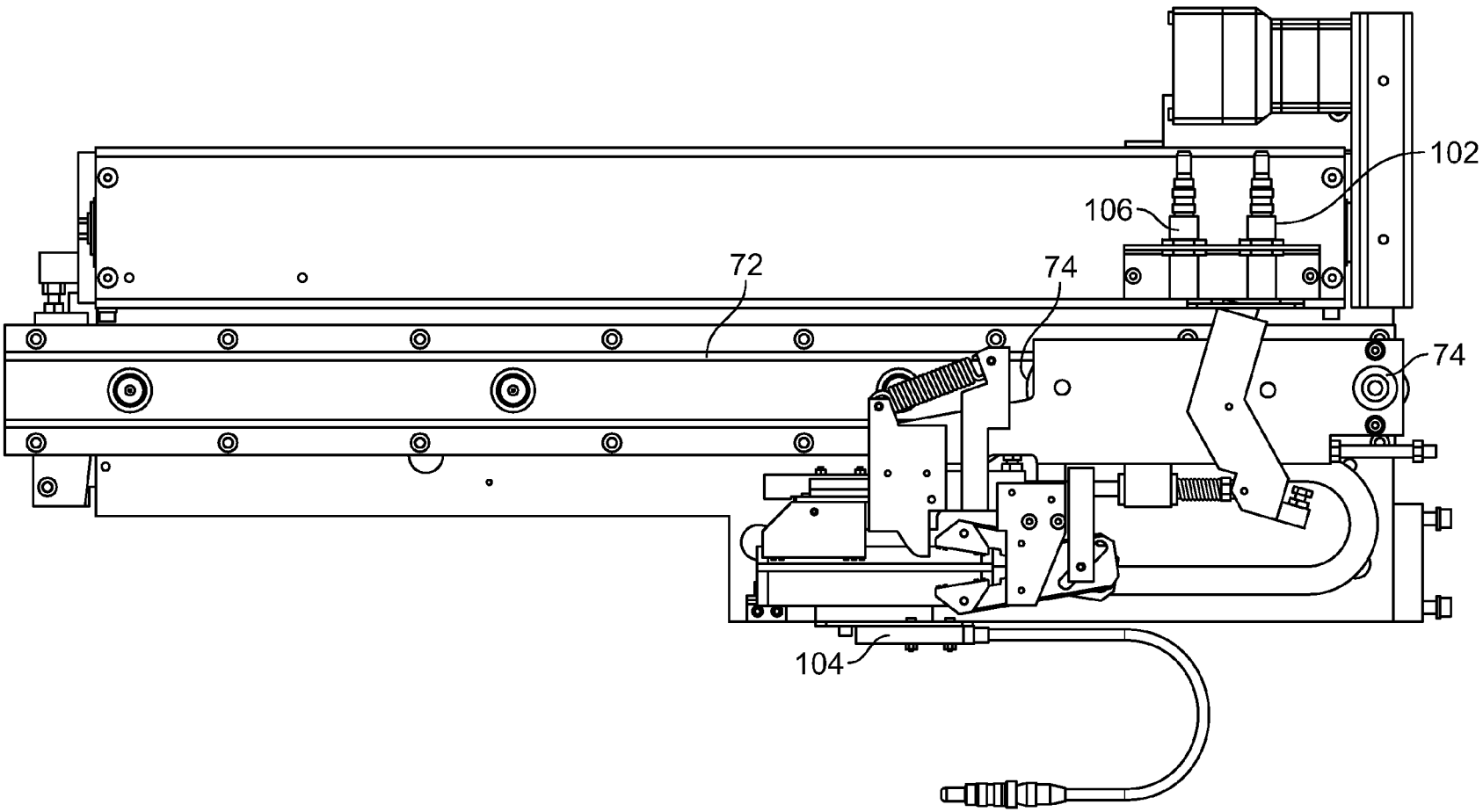
FIG. 7 is an illustration showing the applicator in the loading position.
Figure 8:
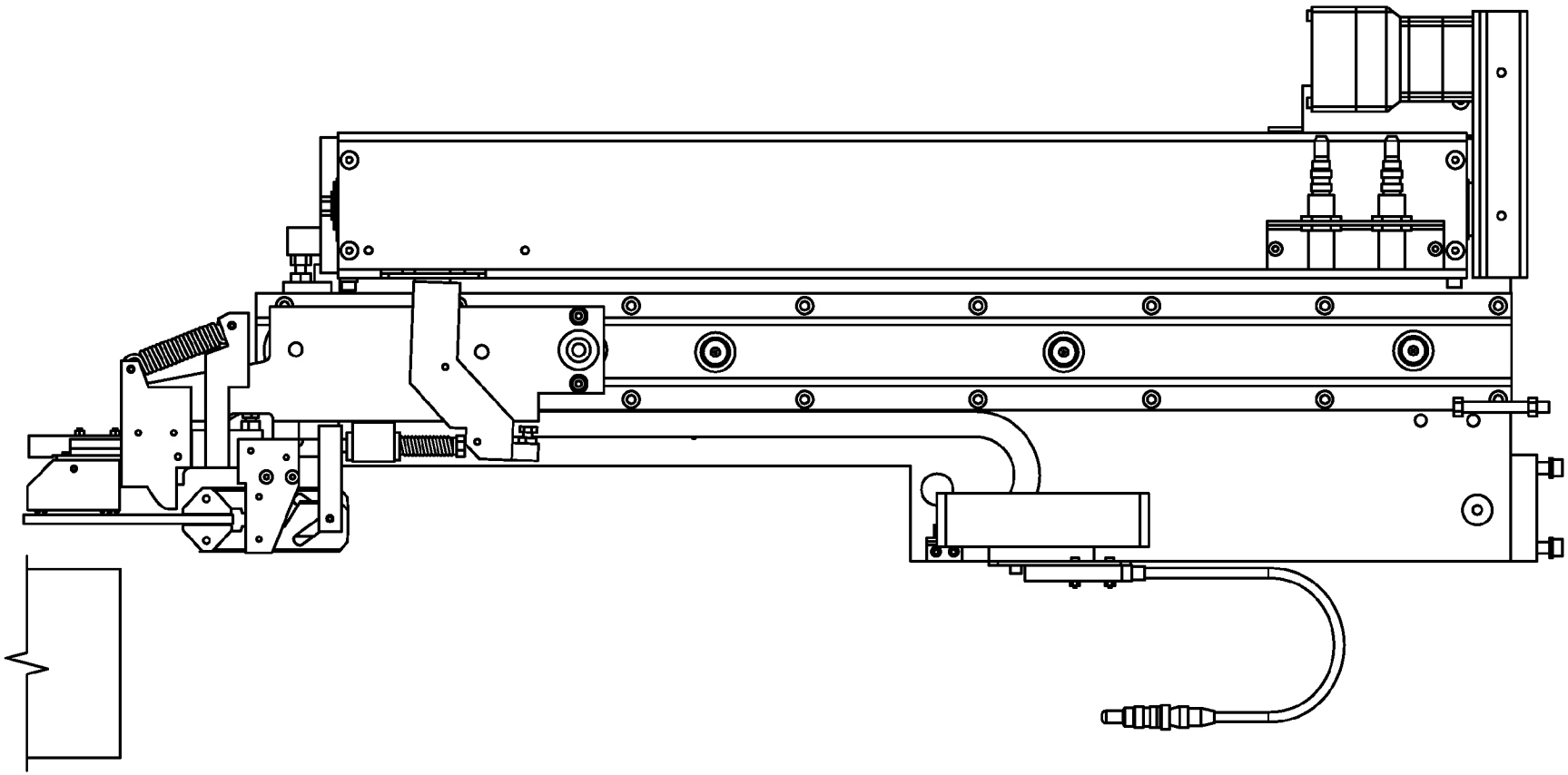
FIG. 8 is an illustration showing the application in position to clamp and apply a corner pad.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1 there is illustrated a press-type strapping machine 10 embodying the principles of the present invention. The term press-type is used to refer to a machine that includes a top press or platen 12 to compress the load L and side squaring elements 14 to square and compress the load L during the strapping cycle. The machine 10 includes a frame 16 on which the components are mounted. A roller table 18 is mounted to the frame 16 along which the load L is moved longitudinally through the strapper 10. The illustrated machine 10 is shown with a load L of lumber resting on the roller table 18.

Figure 12:
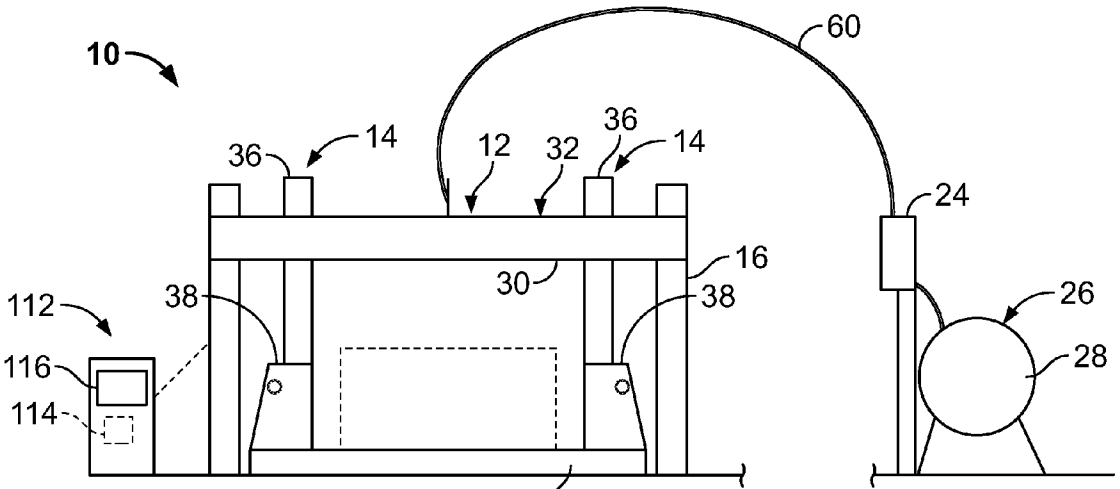
FIG. 12 is a schematic illustration of the strapping machine, strap supply and control system.
Figure 13:
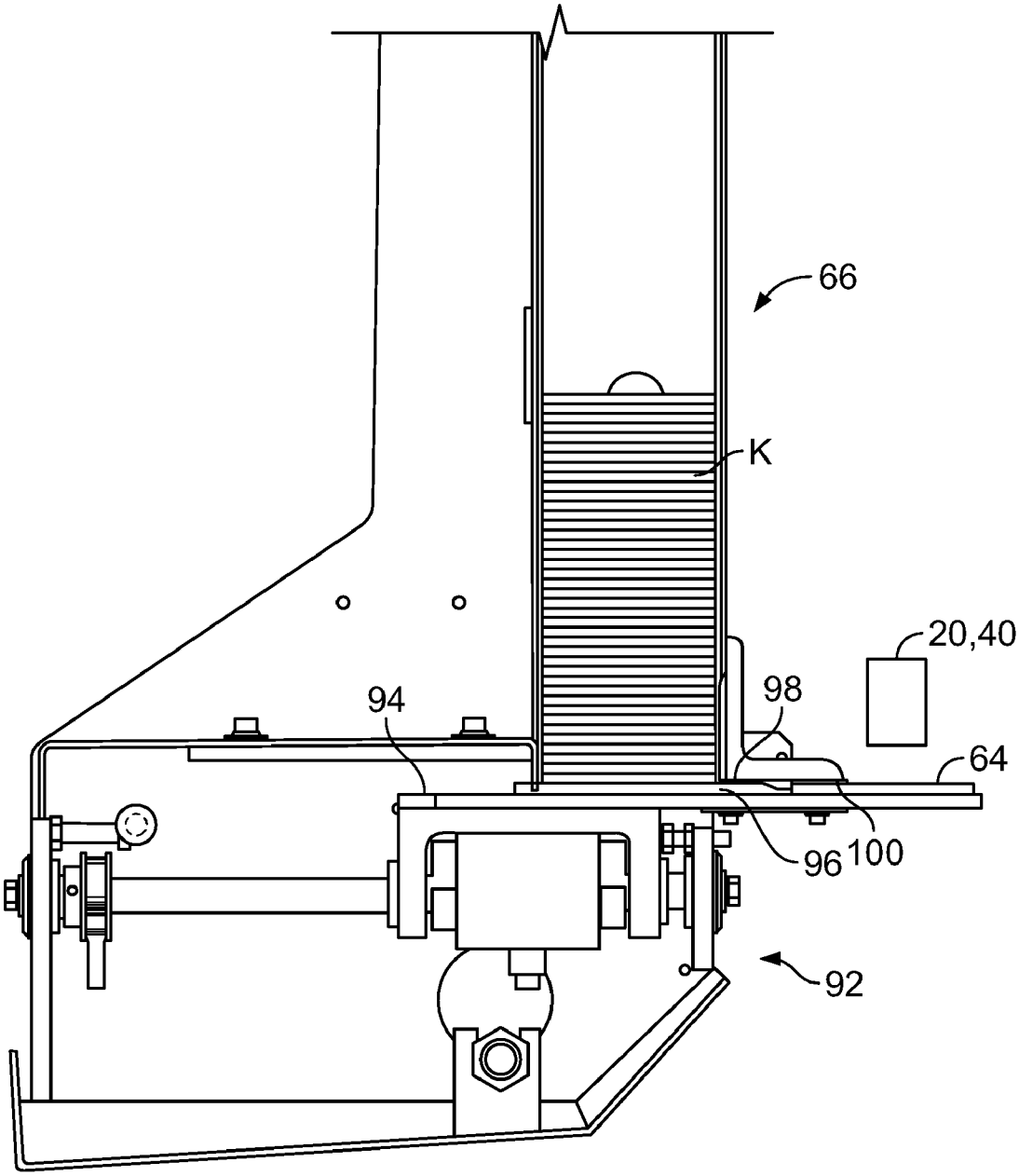
FIG. 13 is a cross-sectional illustration of the pad feeder and magazine.

The machine 10 further includes, generally a strap chute 20, a strapping head 22, a feed head 24 and a strap supply 26. In the present strapper 10, the feed head 24 and strap supply are 26 remotely located from the strapper 10 (see FIG. 12). The supply 26 and feed head 24 are located at about ground elevation to facilitate maintenance and the like on the supply 26 (e.g., replacing dispenser reels 28) and on the feed head 24.

The present strapping machine 10 includes a pair of horizontal compression plates 30*a,b* mounted to a movable upper carriage 32 which is mounted for movement on the frame 16. The plates 30*a,b* are rigidly mounted to the carriage 32 and spaced from one another longitudinally along the load L to provide a larger area over which compression occurs. Movement of the carriage 32, and thus compression is effected by vertical movement of the plates 30. Movement is carried out by drives, such as the illustrated cylinders 34 (one shown) located on each side of the strapper 10 to move the carriage 32 and in turn press the plates 30 downwardly onto the load L. The cylinders 34 can be pneumatic or hydraulic cylinders, or any other drive that provides sufficient force to compress the load L.

Side compression or side squaring is provided by a pair of side compression columns or posts 36 that move horizontally toward and away from the sides S of the load L and contact and compress/square the load L. Each post 36 is mounted to a reinforced support 38 by a mounting pin 39 to permit a small amount of pivoting movement of the posts 36 from a vertical position. In this manner, as the posts 36 move in toward the load L, if the load L is out of square, the posts 36 will first contact that portion of the load that is out of square and, as the column 36 moves inward, it will urge the out of square load members M (e.g., individual pieces of lumber) back into square. It has also been found that minor movements of load members M are more readily effected with the pivotal post 36, because the inward movement from and contact with both sides S of the load L will tend to move the posts 36 to a vertical orientation and thus square the load L. The side squaring elements 14 are driven by, for example, cylinders 35.

In the present strapper 10, the side compression posts 36 are positioned between the horizontal compression plates 30*a,b*. It has been found that such an arrangement provides for more equally distributed forces exerted on the load L.

The strapping machine 10 includes a strap chute 20 through which the strap T is fed to encircle the load L and from which the strap T is pulled to bundle the load L. A portion of the strap chute 20 (the top leg 40) is carried on the upper carriage 32 in close proximity to the compression plates 30, and the strapping head 22 is positioned within a portion of or opening 42 in the top leg 40.

Because of the changing nature of the load L, the height of the load L can vary. Accordingly, the height of the sides 44 of the chute 20 can be varied to accommodate different load L heights. In a present strapping machine 10, the sides 44 of the strap chute 20 are formed from a tiled arrangement, in which the wall 46 of the chute side 44 is formed from small sections 48 (thus the tile description) that pivot to open, and are biased, as by a spring (not shown), to the closed position. Diverters 50 are mounted to the upper carriage 32 (at the chute top leg 44) to provide a transition from each side leg 44 to the top leg 40. The diverter 50 rides in the chute side leg 44 (between opposing tiles 48), and opens the tiles 48 to divert the strap T from the side leg 44 into the top leg 40 (or from the top leg 40 into the side leg 44). In this manner, strap T traversing through the chute 20 is maintained close to the load L.

The strapping head 22 is located on the upper carriage 32, on a forward extension 52 from the front compression plate 30*a*, and includes separate tensioning and sealing modules 54, 56, such as those shown in U.S. patent application Ser. No. 11/852,016, filed Sep. 7, 2007 and commonly owned with the present application, and incorporated herein by reference. Unlike known tensioning arrangements, the present tensioning arrangement 54, 56 uses a linear or rack gear 58 to move the tensioning and sealing modules 54, 56 toward and away from one another. This provides for linear tensioning of the strap T (as compared to tensioning around a rotating element) which reduces curl and deformation of the strap T.

As set forth above, the present strapper 10 uses a remotely located strap supply 26 and feed head 24. Strap T is conveyed to the strapping head 22 through a flexible strap guide 60 that is mounted, at one end, at about the feed head 24, and at the other end, at about the strapping head 22. The flexible guide 60 permits unhindered movement of the upper carriage 32 and a clear, unobstructed guide for conveying the strap T from the feed head 24 to the strapping head 22.

In order to prevent marring of the load L at the upper corners U, the present strapping machine 10 includes a corner protector or pad applicator assembly 62 for applying corner protectors or pads 64 at the upper corners U of the load L at each side. The pad applicator assemblies 62 include a magazine 66 for storing corner pads 64 in a flat form, and a reciprocating arm 68 to move the pads 64 from the magazine 66 to the corner U of the load. A gripping assembly 70 is mounted to the arm 68 to grip the corner pads 64 (being ejected from the magazine 66) and release the pads 64 (at the load corners U). The arm 68 traverses along a rail 72 from the magazine 66 (loading position) to the application position. Rollers 74 are mounted to the arm assembly 68 to provide for moving the arm 68 along the rail 72.

A pad clamp 76 is positioned on the arm assembly 68 forward of the gripping assembly 70. The pad clamp 76 is positioned to clamp the pad 64 on the load corner U when the pad 64 is properly positioned. The clamp 76 maintains the pad 64 in place as the strap T is "pulled" around the load L and is sealed to itself to bundle the load. The assembly 62 includes a prefolding member 78 positioned between the gripping assembly 70 and the clamp 76. The prefolding element 78 reciprocates upward, away from the pad 64, and downward, toward (and into contact with) the pad 64, to prefold or "break" the pad 64 at the corner U as the clamp 76 holds the pad 64 in place on the load L. This facilitates a fold F of the entire pad 64 at the corner U prior to the application of the strap T to the load L, and thus prevents skewed or torn corner protector pads 64.

The gripping assembly 70 is formed by a jaw 80 having a pair of articulating jaw elements 82, 84. The jaw 80 opens to release the pad 64 and swings or pivots downward (see FIG. 6) and away from the load corner U to release the pad 64 and to reduce the opportunity for interfering with strapping cycle. As seen in FIGS. 6-8 and 10, the gripping assembly includes, in addition to the jaw elements 82, 84, a support bracket 86 and an actuator arm 88. The jaw elements 82, 84 are held in and pivot about the bracket 86. The jaw elements 82, 84 each include a slotted drive end 90 mounted to the actuator 88 such that movement of the actuator 88 (relative to the bracket 86 and through the slotted ends 90) pivots the elements 82, 84 between the open and closed positions.

The magazine 66 provides a storage function (a stack K of pads 64) and a feed function to eject individual, singulated pads 64 from the magazine 66 and feed the individual pads 64 to the gripping assembly 70. The pad feeder 92 includes a reciprocating plate 94 with a pusher element 96 that resides below the pad stack K and pushes or feeds individual pads 64 from the bottom of the stack K. A stop bar 98 is positioned at the side of the pad stack K to prevent multiple pads from being ejected at once. A gap 100 is defined, and properly sized, between the reciprocating plate 94 and the stop bar 98, to permit only one pad 64 a time to be ejected.

The pad applicator assembly 62 includes a number of sensors. A loading sensor 102 senses the presence (location) of the assembly 62 for loading a pad 64 into the gripping assembly 70. An ejection sensor 104 senses the presence (location) of a pad 64 ejected from the magazine 66 and ready to be gripped by the gripping assembly 70. A home sensor 106 senses the presence (location) of the assembly 62 at the home position—this is the position in which the assembly 62 is withdrawn to the side of the strapping machine 10. An edge sensor 108 senses the presence (location) of the edge (upper corner U) of the load L to properly position the pad 64 at the load corner U.

In operation, the pad applicator 62 starts with the gripping assembly 70 at the home position; in this position, the jaw 80 is closed. After the load L is squared and compressed, prior to the strap cycle commencing, a signal is received to apply a pad 64 at each of the upper corners U. The assembly 62 moves to the loading position (as sensed by the loading sensor 102), the jaw 80 is opened and a pad 64 is ejected form the magazine 66 into the jaw 80. The jaw 80 then closes and the assembly 62 moves to apply the pad 64 at the corner U. The edge sensor 108 senses the edge (corner U) of the load L and the assembly 62 stops moving inward. The clamp 76 and prefolder move 78 downward such that clamp 76 contacts and holds the pad 64 on the load L, the jaw 80 opens and pivots out of the way and the prefolder 78 moves into contact with the pad 64 to fold the pad 64.

The strapping cycle then commences and a strap T is positioned, tensioned and sealed around the load L with the pads 64 captured within the strap loop. The strapping machine 10 returns to the beginning of a strapping cycle (which will be appreciated by those skilled in the art) and the applicator assembly 62 returns to the home position.

Figure 9:
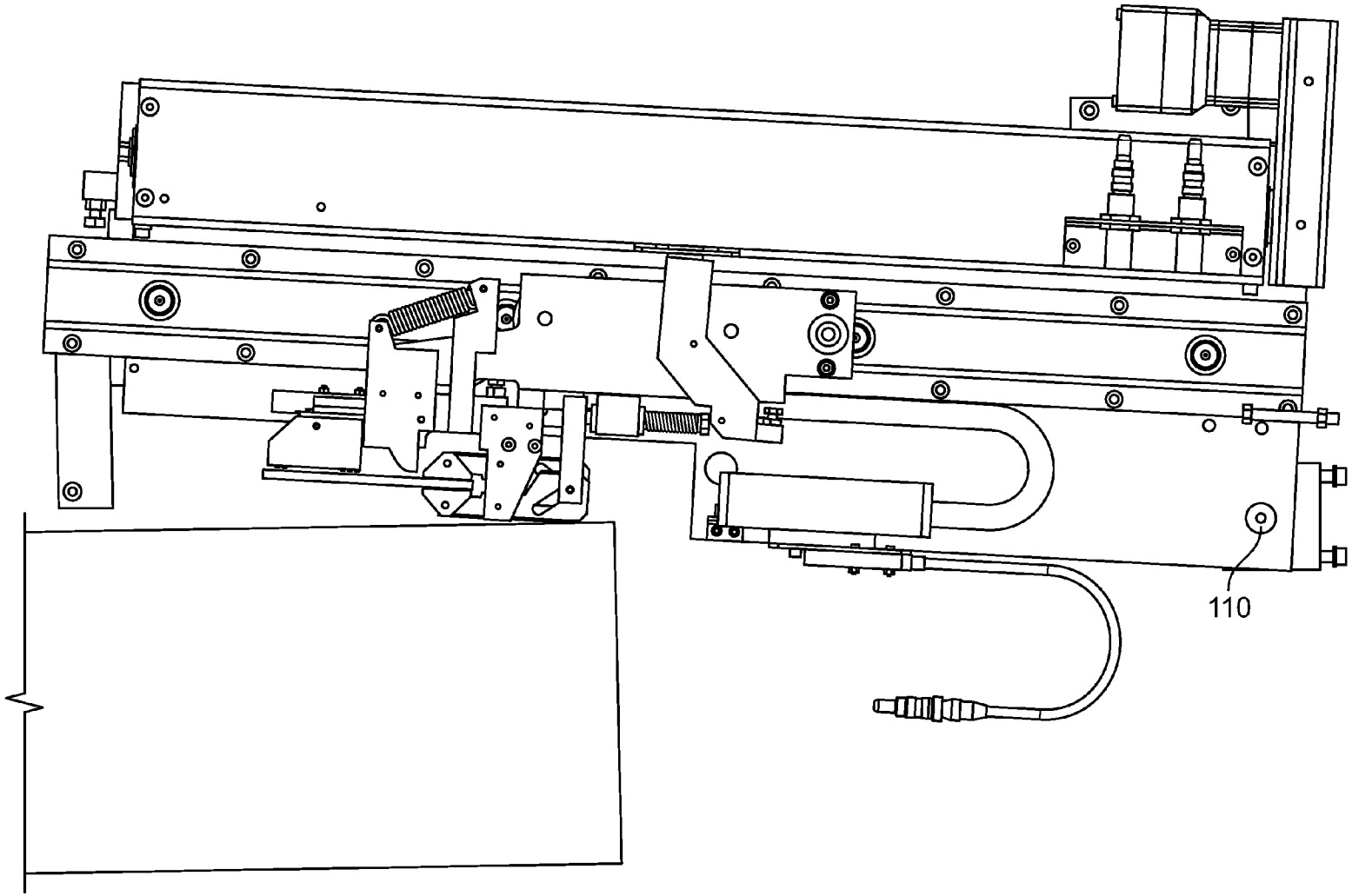
FIG. 9 is an illustration showing the applicator in a crash condition, in which the applicator overshoots the load.
Figure 10:
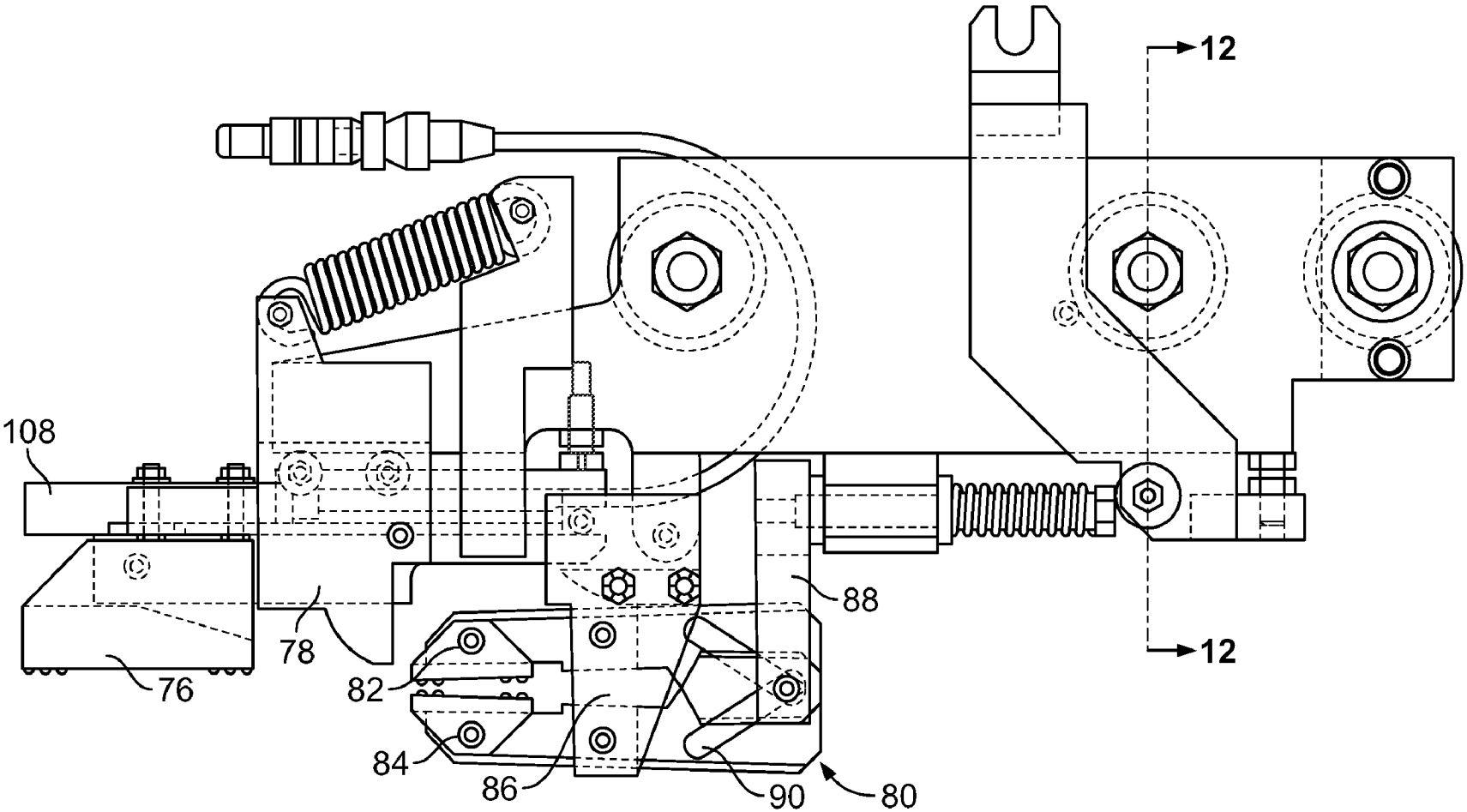
FIG. 10 is an illustration showing various parts of the applicator assembly in phantom and illustrating the carriage along which the assembly moves toward and away from the load.
Figure 11:
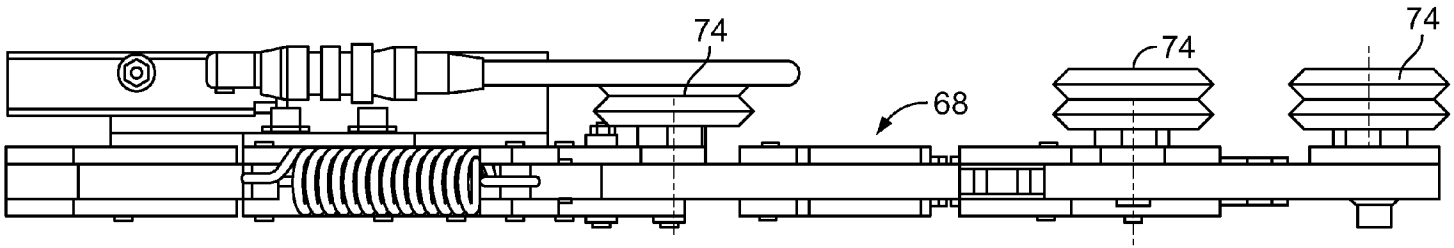
FIG. 11 is a top view of the applicator assembly carriage.

In addition to the home, load and application positions, the applicator 62 also recognized a fault, and includes, for example, a crash position, in which, for example, the applicator overshoots the corner U of the load. In this position (an example of which is shown in FIG. 9), the assembly 62 may contact the load at a non-desired location. To prevent possible damage to the load L, the assembly 62, including the rail 72 and the gripping assembly 70 is pivotally mounted to the upper carriage 32 at a pivot location by, for example, a pivot pin 110. In this manner, in the event there is an out of normal sequence or a fault in the operation of the strapper 10 and/or the pad applicator 62, there is less opportunity for the applicator 62 to be damaged due to contact with the load L and less opportunity for the load L to be damaged due to contact from the pad applicator 62.

A control system 112 controls the operation of the strapper 10. The system 112 includes a microprocessor or like programmable, configurable controller 114 for sensing the state and status of the machine 10 and to generate signals, accordingly, to control the machine 10 functions (e.g., cylinder 34, 35 operation, strapping head 22 operation and the like). Those skilled in the are will appreciate the design and operation of the control system 112. The present control system 112 uses a touch screen 116 that displays the various controls and functions of the machine 10 and that "hides" controls for operations that are not "allowed" or are locked-out at times during machine 10 cycle operation.

As set forth above, the present press-type strapping machine 10 is configured to apply (position, tension and seal) strap T at multiple locations on a single load L. That is, straps T can be placed at a number of locations on, for example, a single a load of lumber. To effect efficient operation, between the application of the several straps T, the compression members 30, 36 of the present machine 10 will move only far enough to allow for longitudinal movement of the load L in the machine 10. In prior machines, once a strap had been positioned around the load at one location, the entire strapping system would reset to a home position, which requires fully retracting the side squaring and compression plates, moving the load (generally only a few feet along the roller base) and then commencing the full strapping cycle once again to position a strap at a different location along the load.

The present machine 10 senses the outer bounds or envelope of the load L and moves the upper carriage 32 and side squaring posts 36 away from the load L only about 2 to 3 inches to allow for longitudinally moving the load L to the next strap T location. This small movement (as compared to full resetting the machine) has been found to save considerable time and result in considerable cost savings, in the strapping process.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strapping machine of the type for positioning, tensioning and sealing a strapping material to itself around a load, comprising:

a frame;

a vertically movable upper carriage;

a strap chute, the strap chute including an upper leg mounted to the movable upper carriage, the strap chute further including variable height side legs mounted to the frame and a bottom leg;

a pair of compression plates mounted to the movable upper carriage for vertically compressing the load, the compression plates being spaced from one another;

a pair of side squaring elements movable toward and away from one another, the side squaring elements configured for horizontal movement to contact sides of the load, the side squaring elements disposed between the compression plates, a first drive for vertically moving the compression plates simultaneously;

a pair of second drives for moving the side squaring plates simultaneously and independent of one another toward and away from the load;

at least one corner pad applicator assembly mounted pivotally to the vertically movable upper carriage for applying a corner pad at an upper corner of the load prior to positioning, tensioning and sealing the strapping material to itself about the load, the at least one corner pad applicator assembly including a reciprocating arm, a pad clamp, and a prefolding element for folding the corner pad;

a strapping head operably connected to the movable upper carriage, the strapping head configured to receive a free end of the strapping material, grip the free end and form a seal of the strapping material onto itself; and a control system, wherein the first drive actuates to move the compression plates into contact with the load to compress the load and wherein the second drives actuate to move the side squaring elements into contact with the load to square sides of the load, the load being compressed on both sides of the squaring elements.

2. The strapping machine in accordance with claim 1 wherein the side squaring elements include posts mounted to support members for movement toward and away from the sides of the load, the posts being mounted to the support members at a pivot to vertically align out of alignment sides of the load.

3. The strapping machine in accordance with claim 2 wherein each of the pair of second drives is mounted to a respective support member at a location at a lower elevation than the pivot.

4. The strapping machine in accordance with claim 1 wherein the reciprocating arm having a gripper for gripping the corner pad as it is conveyed to the upper corner of the load and releasing the pad when it is positioned at the upper corner of the load.

5. The strapping machine in accordance with claim 4 wherein the pad clamp to contact the corner pad and temporarily hold the corner pad to the upper corner of the load prior to and during positioning, tensioning and sealing the strapping material to itself about the load.

6. The strapping machine in accordance with claim 5 wherein the prefolding element operably connected to the pad clamp to fold the corner pad about the upper corner prior to positioning, tensioning and sealing the strapping material to itself about the load.

7. The strapping machine in accordance with claim 4 wherein the gripper is formed from a pair of articulating jaw elements pivotally mounted to one another and to an actuator.

8. The strapping machine in accordance with claim 7 wherein movement of the actuator toward and away from the jaw elements opens and closes the jaw elements.

9. The strapping machine in accordance with claim 4 including a magazine for storing a plurality of corner pads, wherein the corner pads are retrieved from the magazine and conveyed to the upper corner of the load by the gripper.

10. The strapping machine in accordance with claim 9 including a loading sensor to sense the presence or absence of the gripper at the magazine to load a corner pad into the gripper.

11. The strapping machine in accordance with claim 9 including an ejection sensor to sense the presence of a pad ejected from the magazine for retrieval by the gripper.

12. The strapping machine in accordance with claim 9 including a home sensor to sense the presence or absence of the corner pad applicator assembly at a home position.

13. The strapping machine in accordance with claim 1 wherein the at least one corner pad applicator assembly comprises a pair of corner pad applicator assemblies, one for each of the load upper corners.

14. The strapping machine in accordance with claim 1 wherein following a first strapping cycle on the load at a first location and prior to a second strapping cycle on the load at a second location, spaced from the first location, the control system generates a signal to raise the compression plates from the load about 3 inches and a signal to move the side squaring elements away from the load about 3 inches to move the load to the second location.

15. A strapping machine of the type for positioning, tensioning and sealing a strapping material to itself around a load, comprising:

a frame;

a vertically movable upper carriage;

a strap chute, the strap chute including an upper leg mounted to the movable upper carriage, the strap chute further including variable height side legs mounted to the frame and a bottom leg;

a strapping head operably connected to the movable upper carriage, the strapping head configured to receive a free end of the strapping material, grip the free end and form a seal of the strapping material onto itself; and at least one corner pad applicator assembly operably mounted pivotally to the movable upper carriage, the corner pad application configure to apply a corner pad at an upper corner of the load prior to positioning, tensioning and sealing the strapping material to itself about the load, the at least one corner pad applicator assembly including a reciprocating arm, a pad clamp, and a prefolding element for folding the corner pad.

16. The strapping machine in accordance with claim 15 wherein the reciprocating arm having a gripper for gripping the corner pad as it is conveyed to the upper corner of the load and releasing the pad when it is positioned at the upper corner of the load.

17. The strapping machine in accordance with claim 16 wherein the pad clamp to contact the corner pad and temporarily hold the corner pad to the upper corner of the load prior to and during positioning, tensioning and sealing the strapping material to itself about the load.

18. The strapping machine in accordance with claim 17 wherein the prefolding element operably connected to the pad clamp to fold the corner pad about the upper corner prior to positioning, tensioning and sealing the strapping material to itself about the load.

19. The strapping machine in accordance with claim 16 wherein the gripper is formed from a pair of articulating jaw elements pivotally mounted to one another and to an actuator.

20. The strapping machine in accordance with claim 19 wherein movement of the actuator toward and away from the jaw elements opens and closes the jaw elements.

21. The strapping machine in accordance with claim 16 including a magazine for storing a plurality of corner pads, wherein the corner pads are retrieved from the magazine and conveyed to the upper corner of the load by the gripper.

22. The strapping machine in accordance with claim 16 including a loading sensor to sense the presence or absence of the gripper at the magazine to load a corner pad into the gripper, an ejection sensor to sense the presence of a pad ejected from the magazine for retrieval by the gripper and a home sensor to sense the presence or absence of the corner pad applicator assembly at a home position.

23. The strapping machine in accordance with claim 15 wherein the at least one corner pad applicator assembly comprises a pair of corner pad applicator assemblies, one for each of the load upper corners.

* * * * *

UNITED STATES PATENT AND TRADEMARK OFFICE

CERTIFICATE OF CORRECTION

PATENT NO. : 7,428,865 B1
APPLICATION NO. : 11/860200
DATED : September 30, 2008
INVENTOR(S) : Kasel et al.

It is certified that error appears in the above-identified patent and that said Letters Patent is hereby corrected as shown below:

Claim 15, Column 9, Line 7 should read, "corner pad applicator configured to apply a corner pad at"

Signed and Sealed this

Eighteenth Day of November, 2008

JON W. DUDAS
*Director of the United States Patent and Trademark Office*